US005900178A

United States Patent [19]

Johnsen

[11] Patent Number: 5,900,178

[45] Date of Patent: May 4, 1999

[54] DEVICE FOR MELTING SNOW OR ICE

[76] Inventor: Asle Ingmar Johnsen, Bjornsonsvei 13, N-3117, Tonsberg, Norway

[21] Appl. No.: 08/875,156

[22] PCT Filed: Jan. 17, 1996

[86] PCT No.: PCT/NO96/00012

§ 371 Date: Oct. 14, 1997

§ 102(e) Date: Oct. 14, 1997

[87] PCT Pub. No.: WO96/22567

PCT Pub. Date: Jul. 25, 1996

[30] Foreign Application Priority Data

Jan. 18, 1995 [NO] Norway ..... 950188

[51] Int. Cl.[6] ..... H05B 1/02

[52] U.S. Cl. ..... 219/497; 219/213; 219/494; 219/492; 126/271.2 A; 246/428; 237/80; 340/581

[58] Field of Search ..... 219/213, 497, 219/501, 505, 508, 494, 499, 492; 246/428, 218; 237/80; 126/271.2 A; 340/581, 580, 962

[56] References Cited

U.S. PATENT DOCUMENTS

| | | | |
|---|---|---|---|
| 3,540,655 | 11/1970 | Hinrichs . | |
| 4,693,301 | 9/1987 | Baehrle et al. | 165/45 |
| 4,887,163 | 12/1989 | Ringer | 246/428 |
| 5,345,223 | 9/1994 | Rukiewicz . | |
| 5,391,858 | 2/1995 | Tourangeau et al. . | |
| 5,515,689 | 5/1996 | Atterbury | 62/80 |
| 5,523,959 | 6/1996 | Seegmiller | 364/550 |
| 5,643,482 | 7/1997 | Sandleman et al. | 219/497 |
| 5,710,408 | 1/1998 | Jones | 219/481 |

FOREIGN PATENT DOCUMENTS

| | | |
|---|---|---|
| 0481315 A2 | 4/1992 | European Pat. Off. . |
| 62-168083 | 1/1986 | Japan . |
| 2-210142 | 2/1989 | Japan . |

OTHER PUBLICATIONS

Stig Loden et al., "Fritt fran sno oc is med varmekabel," Elinstallatoren, vol. 57, No. 12, pp. 44–49, 1991.

*Primary Examiner*—Mark Paschall

*Attorney, Agent, or Firm*—Clifford W. Browning; Woodard, Emhardt, Naughton Moriarty & McNett

[57] ABSTRACT

An installation for melting of snow or ice, e.g. at roof downpipes on flat roofs, in gutters and the like, comprising a heating means (11), a temperature sensor means (4,6) and a control unit (1) for connecting and disconnecting the heating means (11) in dependence on sensed temperature. The temperature sensor means comprises a first temperature sensor (4) for sensing the surface temperature at the place of snow or ice melting, and a second temperature sensor (6) for sensing the air temperature at the topical place. On the surface there is further arranged a snow sensor (7) which is connected by the control unit (1) when the first temperature sensor (4) at a rising temperatures registers that the surface temperature rises above a chosen minus value, or when the second temperature sensor (6) at a falling temperature registers that the air temperature falls below a chosen plus value, the control unit (1) causing connection of the heating means (11) if the snow sensor (7) registers snow during a chosen time period, and further keeping the heating means (11) connected at least until the second temperature sensor (6) at a rising temperature registers that the air temperature rises above the chosen plus value, or at least until the first temperature sensor (4) at a falling temperature registers that the surface temperature falls below the chosen minus value, but in both cases only on the condition that the snow sensor (7) at intervals registers snow.

10 Claims, 2 Drawing Sheets

DEVICE FOR MELTING SNOW OR ICE

The invention relates to an installation for melting of snow or ice, especially on roofs, in roof downpipes and gutters, and around manholes in roadways and the like, comprising a heating means, a temperature sensor means and a control unit for connecting and disconnecting the heating means in dependence on sensed temperature.

BACKGROUND OF THE INVENTION

There are previously known different embodiments of control systems for the control of heating cables or the like for snow and ice melting at roof downpipes, in gutters and the like. In principle, two control systems are on the market today. One of these measures the air temperature and connects heating cables in an adjustable temperature interval, e.g. between −5 and +5° C. The other system measures an air temperature and combines this with a water sensor in a gutter, and a heating cable is kept connected as long as the temperature is below the melting point at the same time as the water sensor registers moisture in the gutter.

The weakness of the first system is that it uses much current. The second system will be connected as long as one has minus degrees and snow. However, much dirt always gathers in gutters, something which may rapidly cause errors in the water sensor registration.

SUMMARY OF THE INVENTION

The object of the present invention is to provide an installation which in an efficient manner prevents ice formation and thereby ensures a free water passage at the introductorily mentioned places, and which is very economic in operation, the power consumption being very low as compared to installations according to the prior art.

The above-mentioned objects are achieved with an installation of the introductorily stated type which, according to the invention, is characterized in that the temperature sensor means comprises a first temperature sensor for sensing the surface temperature at the place of snow or ice melting, and a second temperature sensor for sensing the air temperature at the topical place, and that a snow sensor is arranged on said surface, which sensor is connected by the control unit when the first temperature sensor at a rising temperature registers that the surface temperature rises above a chosen minus value, or when the second temperature sensor at a falling temperature registers that the air temperature falls below a chosen plus value, the control unit causing connection of the heating means if the snow sensor registers snow during a chosen time period, and further keeping the heating means connected at least until the second temperature sensor at a rising temperature registers that the air temperature rises above the chosen plus value, or at least until the first temperature sensor at a falling temperature registers that the surface temperature falls below the chosen minus value, but in both cases only on the condition that the snow sensor at intervals registers snow.

A principal feature of the installation according to the invention is that there are used two temperature sensors for controlling connection and disconnection of the heating means of the installation, usually a heating cable, namely a first sensor for sensing the surface temperature at the topical place, e.g. a roof surface, and a second sensor for sensing the air temperature at the place. As known, the temperature at a roof surface of a building will be more or less above the temperature of the ambient air because of the heat from the roof. The temperature difference between the surface temperature and the air temperature will never be constant, but will vary with the snow quantities on the roof and the moisture content in the snow. In addition, it will vary between different buildings, dependent on insulation and ventilation. In the installation according to the invention, both said temperatures are measured, so that the operation of the installation is made independent of variations in said temperature difference. One achieves thereby that the heating cable of the installation is only connected in the periods wherein there is a need for this, viz. when the air temperature is in the range between 0° C. and the minus value at which the surface temperature at the topical place, e.g. a roof surface, is equal to 0° C.

BRIEF DESCRIPTION OF THE DRAWING

The invention will be further described below in connection with exemplary embodiments with reference to the drawings, wherein.

DETAILED DESCRIPTION OF THE PREFERRED EMBODIMENTS

Figure 1:
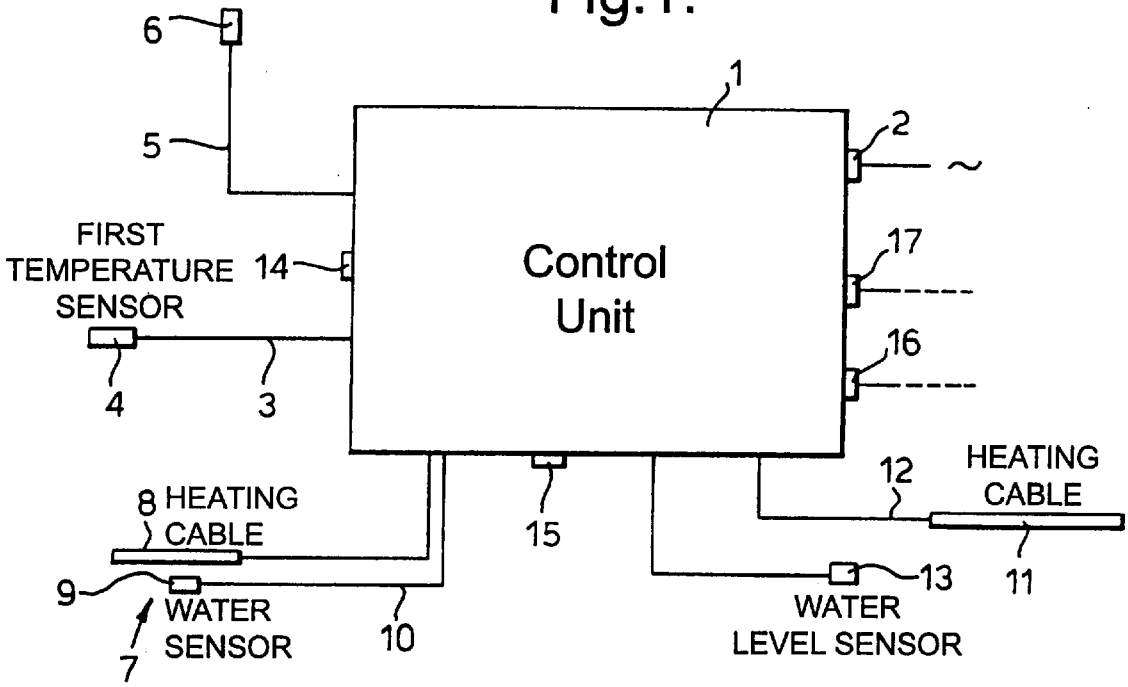
FIG. 1 shows a principle drawing of an installation according to the invention.

The installation shown in FIG. 1 comprises a control unit 1 in the form of an electronics part to which the different sensors and other equipment forming part of the installation, are connected. The control unit is constituted by a box containing different electric/electronic circuits for operation and control of the installation, so that this works in the manner described below. The circuits are constructed to comply with particular operational specifications and are based on conventional technique with which an expert in the topical field will be familiar. A further description of the construction and operation of these circuits is not considered to be necessary for the understanding of the invention, and is therefore not included in the present description.

As appears from FIG. 1, the control unit 1 has an input 2 for connection of operating voltage, i.e. normally 220 V alternating voltage. A line 3 leads to a first temperature sensor 4 for sensing the surface temperature at the place where snow and/or ice is to be melted, e.g. a roof surface, and a second line 5 leads to a second temperature sensor 6 for sensing the air temperature at the topical place. Said lines consist of cables of suitable length and quality. To the unit there is further connected a snow sensor 7 consisting of a suitable heating cable 8 and a water sensor or water detector 9 which is connected to the unit via a suitable cable 10. The water sensor e.g. may consist of a pair of acidproof pins.

The heating means of the installation consists of a heating cable 11, e.g. of maximum 3,6 kW, which is connected to the control unit via a cable 12.

To the control unit 1 there is also connected a water level sensor 13 which has the task to warn if gutters become filled with water. Further, the control unit has an input 14 for connection of an extra surface temperature sensor, and an input 15 for connection of an extra snow sensor. There is also arranged an input 16 for connection of a switch (23 in FIG. 3) for manual forced control, i.e. connection of the installation for e.g. 24 hours irrespective of the temperature conditions. Finally, the control unit is provided with an input 17 for connection of a control panel for inspection and control of the different installation functions.

Figure 2:
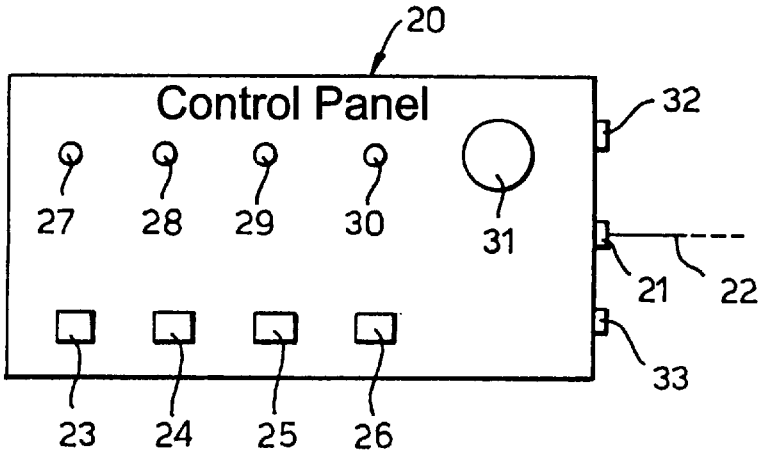
FIG. 2 shows a schematic view of a control panel which may form part of the installation.

FIG. 2 shows an embodiment of the control panel which is designated 20. The panel has an output 21 for connection of a suitable multicore cable 22 leading to the input 17 of the control unit. On the panel there is arranged a number of switches, more specifically a switch 23 for connection and disconnection of the installation, a switch 24 for the above-mentioned forced control of the installation, and a switch 25 for resetting of the installation after a water level alarm (warned by means of the sensor 13). There is also arranged a switch 26 for automatic disconnection of the entire installation when the air temperature sensor 6 registers a temperature exceeding a certain limit, e.g. +5° C. Thereby overheating of the roof covering is avoided if the heating cable should be connected through a fault.

The panel further includes a number of monitor lamps, e.g. light emitting diodes, more specifically a lamp 27 (green) which is lighted when the installation is connected, a lamp 28 (blue) which is lighted when the snow sensor 7 is connected, a lamp 29 (yellow) which is lighted when the main heating cable 11 is connected, and a lamp 30 (red) which is lighted when a water level alarm is delivered. In addition to lighting of the lamp 30 with such an alarm, there is also delivered an audio signal from a buzzer 31.

The control panel 20 in addition has an output 32 for forwarding the water level alarm to a plant for central operations control, and also an output 33 for a loudspeaker or a siren.

Figure 3:
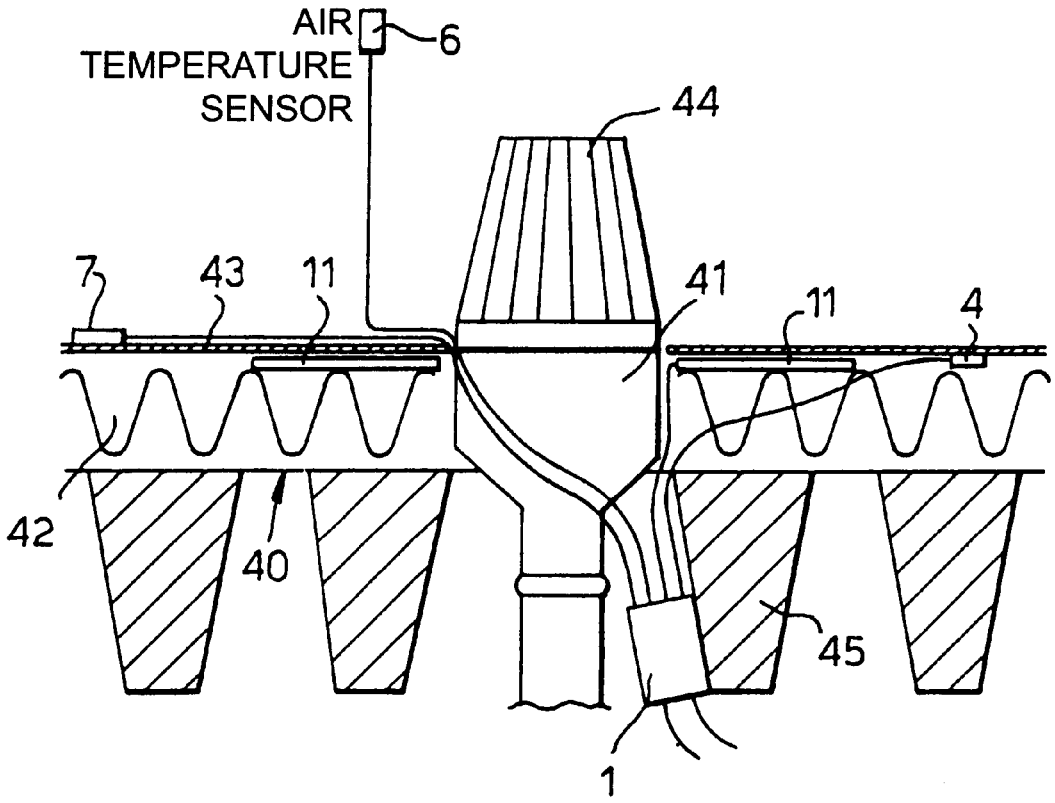
FIG. 3 shows a schematic sectional view of a roof downpipe wherein there is fitted an installation according to the invention.

FIG. 3 shows a schematic sectional view of a part of a flat roof 40 were an installation according to the invention is fitted in connection with a roof rainwater outlet having an internal downpipe. As appears, the roof is insulated by an insulation 42 which is covered by a roof covering 43. The roof outlet is covered by a gully cap 44.

The control unit 1 of the installation is shown to be fastened to a roof element 45, but it may instead e.g. be fitted at a remote central place, possibly for the control of heating means at different places. The control unit is connected via respective lines with the heating means 11, with the snow sensor 7, with the surface temperature sensor 4 and with the air temperature sensor 6. The heating means may consists of a heating carpet or of a suitable arrangement of one or more heating cables arranged around the gully 41. The different sensors are fitted at a suitable distance from the gully.

The manner of operation of the installation will be further described below, and firstly in the case in which the temperature is rising.

The temperature sensor 4 measures the surface temperature of the roof surface and connects the snow sensor 7, i.e. the heating cable 8 and the water detector 9, when the temperature rises and passes a chosen value of −0,4° C. If the water detector 9 registers water during a period of 30 minutes after connection, the main heating cable 11 is connected by the control unit 1, and at the same time the heating cable 8 of the snow sensor is disconnected. The main heating cable remains connected until the air temperature sensor 6 registers that the air temperature has risen to a chosen value of +0,4° C. This is, however, conditioned by the fact that the snow sensor 7 at intervals registers snow at the roof surface. For this reason the water detector 9 is connected again for a chosen time period of 10 minutes every four hours after the first disconnection. (In this case the snow sensor heating cable 8 is not connected.) If water is registered during said time period, the main heating cable 11 shall still be connected. If, however, water is not registered in the course of the period (10 min.), the heating cable is switched off even if the air temperature has not reached +0,4° C.

When the temperature is falling, the manner of operation is as follows:

When the air temperature sensor 6 registers that the air temperature falls below the chosen value of +0,4° C., the snow sensor 7 is connected, which sensor controls if there is snow on the roof, in a manner corresponding to that described above (the heating cable 8 and the water detector 9 are connected for 30 min.). If snow is not registered, the installation becomes torpid. If snow is registered, the main heating cable 11 is connected and remains connected until the surface temperature. sensor 4 registers that the surface temperature falls below −0,4 ° C. At the same time as the heating cable 11 is connected, the water sensor 9 checks if water still arrives, more specifically for ten minutes every four hours. If water is not registered, the heating cable is switched off.

The above-mentioned function of the installation in case of falling temperature shall be able to be disconnected by means of a switch (not shown) in the control unit. This is important for current saving when the installation is used on glass roofs.

It should be noted that the stated temperature limits of ±0,4° C. for the current sensors are chosen as a safety margin to ensure that the installation is not connected too late or disconnected too early because of inaccuracy in the meters. It may also be appropriate to use a larger safety margin, e.g. ±1 ° C. If quite accurate temperature meters are presupposed, the temperature limits will be ±0° C.

In addition to the above-mentioned functions, the control unit may also be arranged to disconnect the main heating cable 11 only after a chosen time period after said chosen temperature limit has been registered by the topical temperature sensor. This time period may be adjustable, e.g. in steps of one hour for up to 6 hours. In this manner one may pick up or compensate for variations in the construction or in the snow depth. For example, it is not sure that the surface temperature sensor will always be fitted were the heat loss is greatest. Further, the air temperature sensor may be subjected to an unintentional heat influence, e.g. from a window which is opened.

I claim:

1. An installation for melting of snow and ice, especially on the surface of roofs, roof downpipes and gutters, and around manholes in roadways and the like, comprising:

a heating means for melting snow or ice on said surface;

a temperature sensor means comprising a first temperature sensor for sensing the temperature of said surface, and a second temperature sensor ambient air temperature at said surface;

a control unit for connecting and disconnecting said heating means in dependence on the temperatures sensed by said temperature sensors; and a snow sensor arranged on said surface and connected to said control unit, said control unit being arranged to connect said snow sensor when said first temperature sensor at a rising temperature registers that the surface temperature rises above a chosen minus value, or when the second temperature sensor at a falling temperature registers that the air temperature falls below a chosen plus value, the control unit causing connection of the heating means of the snow sensor registers snow during a chosen time period, and further keeping the heating means connected at least until the second temperature sensor at a rising temperature registers that the air temperature rises above the chosen plus value, or at least until the first temperature sensor at a falling temperature registers that the surface temperature falls below the chosen minus value, but in both cases only on the condition that the snow sensor registers snow during said chosen time period.

2. Installation according to claim 1, CHARACTERIZED IN that the chosen time period in which the snow sensor (7) has to register snow, is 30 min.

3. Installation according to claim 1 or 2, CHARACTERIZED IN that the chosen minus value of the surface temperature is in the range 0° C. to −1° C., and the chosen plus value of the air temperature is in the range 0° C. to +1° C.

4. Installation according to claim 3, CHARACTERIZED IN that the minus value is about −0,4° C. and the plus value is about ±0,4° C.

5. Installation according to claim 1, characterized in that the control unit (1) is arranged to disconnect the heating means (11) only after a chosen time period after that said chosen temperature limit is registered by the topical temperature sensor (4 or 6).

6. Installation according to claim 5, CHARACTERIZED IN that the chosen time period is adjustable, e.g. in steps of one hour for up to 6 hours.

7. Installation according to claim 1, characterized in that the control unit (1) is arranged to disconnect the snow sensor (7) simultaneously with connection of the heating means (11).

8. Installation according to claim 7, CHARACTERIZED IN that the control unit (1) is arranged to connect the snow sensor (7) again for a chosen time period, e.g. of 10 min., every four hours after said disconnection.

9. Installation according to claim 1, characterized in that it is provided with a switch (26) for automatically interrupting the voltage supply to the installation when the second temperature sensor (6) senses an air temperature exceeding a certain limit, e.g. +5° C.

10. Installation according to claim 1, characterized in that it includes a control panel (20) having switches (23–26) and lamps (27–30) for supervision and inspection of the different installation functions.

* * * * *

UNITED STATES PATENT AND TRADEMARK OFFICE

CERTIFICATE OF CORRECTION

PATENT NO. : 5,900,178

DATED : May 4, 1999

INVENTOR(S) : Asle Ingmar Johnson

It is certified that error appears in the above-identified patent and that said Letters Patent is hereby corrected as shown below:

In col. 4, line14, please delete the period after "temperature".

In col. 4, line 52, please insert --for sensing-- after sensor.

In col. 4, line 67, please change "of" to --if--.

In col. 5, line 19, please change "+" to --t--.

Signed and Sealed this

Twenty-first Day of December, 1999

*Attest:*

Q. TODD DICKINSON

*Attesting Officer*

*Acting Commissioner of Patents and Trademarks*